United States Patent [19]

Pounder

[11] Patent Number: 4,580,729

[45] Date of Patent: Apr. 8, 1986

[54] SPRINKLER HEAD WITH IMPROVED SPRAY UNIFORMITY

[75] Inventor: Donald B. Pounder, North Kingstown, R.I.

[73] Assignee: Grinnell Fire Protection Systems Co., Inc., Providence, R.I.

[21] Appl. No.: 693,123

[22] Filed: Jan. 22, 1985

[51] Int. Cl.[4] ..... B05B 1/26; A62C 37/08

[52] U.S. Cl. ..... 239/524; 239/DIG. 7; 169/37

[58] Field of Search ..... 169/37, 38, 39, 41; 239/506, 518, 524, DIG. 7

[56] References Cited

U.S. PATENT DOCUMENTS

| | | | |
|---|---|---|---|
| 1,797,919 | 3/1931 | Loepsinger | 169/38 |
| 3,525,402 | 8/1970 | Hattori | 169/40 |
| 3,716,103 | 2/1973 | Tanaka | 169/42 |
| 4,279,309 | 7/1981 | Fischer et al. | 169/37 |
| 4,405,018 | 9/1983 | Fischer | 169/37 |

OTHER PUBLICATIONS

"Extended Coverage Horizontal Sidewall Spindlers (F950)", Grinnell Fire Protection Company, Inc., Sep. 1982.

"Model 'A' Center Strut Automatic Sprinkler", *Central Sprinkler Company,* product specification sheet.

"Upright and Pendant Sprinklers (F980)", *Grinnel Fire Protection Systems Company, Inc.,* Oct. 1984.

"Micromatic TM Sprinkler Model M", *Viking Sprinkler Company,* (Aug. 1981).

Product Literature, *Grunau Sprinkler Manufacturing Division.*

*Primary Examiner*—Joseph F. Peters, Jr.

*Assistant Examiner*—David P. Davidson

[57] ABSTRACT

A fire protection sprinkler head which can reduce or substantially eliminate frame shadow effects that produce non-uniformity in spray pattern. The head is of the known type having a base with a throat through which fire retardant fluid flows and two or more frame arms which extend outwardly from the base and joint in an arch-form to support, in the path of fluid discharged from the throat, a central boss which deflects the fluid outwardly. It is found that a surprising reduction in frame shadow affects is obtained by constructing the frame arms to conform to the set of three essential parameters: (1) the portion of each frame arm in the region adjacent the boss is shaped and positioned to intercept the stream profile to a depth of at least one third the distance from the outside periphery to the center of the profile; (ii) the angle of the leading edge of each frame arm in this fluid intercept region, relative to the axis of flow, is less than about 25 degrees; and (iii) the cross-section of each frame arm in the fluid intercept region is slender, its length being two or more times the thickness of the frame arm, with the surfaces of each frame arm shaped to guide the fluid intercepted by that frame arm to flow into the region immediately downstream of its trailing edge.

7 Claims, 9 Drawing Figures

SPRINKLER HEAD WITH IMPROVED SPRAY UNIFORMITY

The invention relates to the problem of "frame shadow" which occurs with automatic fire protection sprinkler heads and the like. Many heads have frame arms that support bosses and deflectors in the stream of the fire retardant fluid. These frame arms tend to cause voids (frame shadow) in the pattern of spray that is produced.

When a fire occurs, nonuniformity of spray pattern increases the likelihood that the first sprinkler head to operate will be insufficient and that two or more sprinkler heads will have to operate to bring the fire under control. This can delay the time to fire suppression and, therefore, increase the likelihood of greater fire and water damage. The desirability of achieving a more uniform distribution of the spray from a single sprinkler head has, therefore, long been recognized. Uniformity is of particular importance for residential occupancies, industrial occupancies that contain flammable plastic materials and warehouses where highly flammable goods are stacked in racks.

Designers have sought to reduce the effect of the frame arms by streamlining the frame arm contours or changing other parameters of the frame arm or by special design of the deflector that is generally positioned downstream of the frame arms, but substantial nonuniformity of spray pattern has remained. Others have sought to improve the uniformity of spray distribution by relatively complex additional features which can be difficult or expensive to manufacture, limited in performance, or affected by other drawbacks.

Objects of the present invention are to provide a sprinkler head which produces a spray distribution pattern that is not substantially disturbed by frame shadow effects and which requires no added expense over the cost of traditional basic sprinkler components.

SUMMARY OF THE INVENTION

In particular, the invention relates to the known type of fire protection sprinkler head which has a throat of predetermined cross-section through which a stream of fire retardant fluid can flow and a frame comprising two or more frame arms and a central boss for supporting a spray distributing deflector, the frame arms extending outwardly from the base and joining in an arch-form to support the boss at a position spaced from and disposed in the path of fluid discharged from the throat, the boss being adapted to deflect fluid towards the spray distributing deflector.

According to the invention, it has been discovered that a surprising reduction in frame shadow effects can be achieved if the frame arms of the sprinkler head conform to the following set of three essential parameters:

(i) the portion of each frame arm in the region adjacent its boss is shaped and positioned to intercept the profile of the stream of fire retardant fluid emerging from the throat to a depth of at least one third of the distance from the outside periphery to the center of the stream profile, this profile comprising a projection parallel to the axis of flow, of the exit cross-section of the throat;

(ii) the angle of the leading edge of each frame arm in this fluid intercept region, relative to the axis of flow, is less than about 25 degrees; and (iii) the cross-section of each frame arm in the fluid intercept region is slender, the length of this cross-section, measured perpendicular to the leading edge of the frame arm, being two or more times the maximum thickness of the frame arm, with the surfaces of each frame arm shaped to guide the fluid intercepted by that frame arm to flow into the region immediately downstream of its trailing edge.

In particular, the criticality of the angle of the leading edge of the frame arm is remarkable. It is found, with decreasing the angle, at approximately 25 degrees there is a dramatic reduction in the disruption of the fluid flow so that the fluid remains available to flow around the frame arms to the region downstream of the arms. It is found, however, that the desired flow will not sufficiently occur if the aspect ratio of the frame arm is too small, i.e. less than about two, or if there is insufficient depth of fluid intercept, i.e less than about one third the depth from the outside periphery to the center of the stream.

When all three of the parameters are met, the undisrupted flow is enabled to attach itself to the frame arm contour and to reach the region downstream of the frame arm in a manner to surprisingly reduce frame shadow effects.

In preferred embodiments, the portion of each frame arm in the region adjacent the boss is shaped and positioned to intercept the stream profile to a depth of about one half of the distance from the outside periphery to the center of the profile; the angle of the leading edge of each frame arm is about 20 degrees; the length of the cross section of each frame arm in the fluid intercept region is about three times the maximum thickness of the frame arm; the frame arm cross-section is of generally streamline shape with narrow or tapered leading and trailing portions, preferably the cross-section being of ellipsoidal shape; and the leading edges of the frame arms in the fluid intercept region are substantially straight.

To obtain a particularly uniform sprinkler distribution pattern essentially free of frame shadow effects preferably the frame arms conform to the following restricted set of parameters:

(i) the portion of each frame arm in the region adjacent its boss is shaped and positioned to intercept about one half of the radial dimension of the stream profile, this profile comprising a projection, parallel to the axis of flow, of the exit cross-section of the throat, the exit cross-section being substantially circular, (ii) the leading edge of each frame arm in the fluid intercept region is substantially straight and forms an angle, relative to the axis of flow, of about 20 degrees; and (iii) the cross-section of each frame arms is of generally slender, streamline shape with narrow leading and trailing portions, the length of the cross-section of each frame arm in the fluid intercept region, measured perpendicular to the leading edge of the frame arm, being about three times the maximum thickness of the frame arm, whereby fluid intercepted by each frame arm can be guided to flow into the region immediately downstream of the trailing edge of the frame arm.

Other features and advantages of the invention will be understood from the following description of the presently preferred embodiment, and from the claims.

PREFERRED EMBODIMENT

We first briefly describe the drawings.

DRAWINGS

FIG. 3 is a somewhat diagrammatic front view of the sprinkler head of the invention in operation, while

FIG. 6 is a perspective view of the central boss with the frame arm removed, to show flow of fluid upon the boss surface, while

Figure 1:
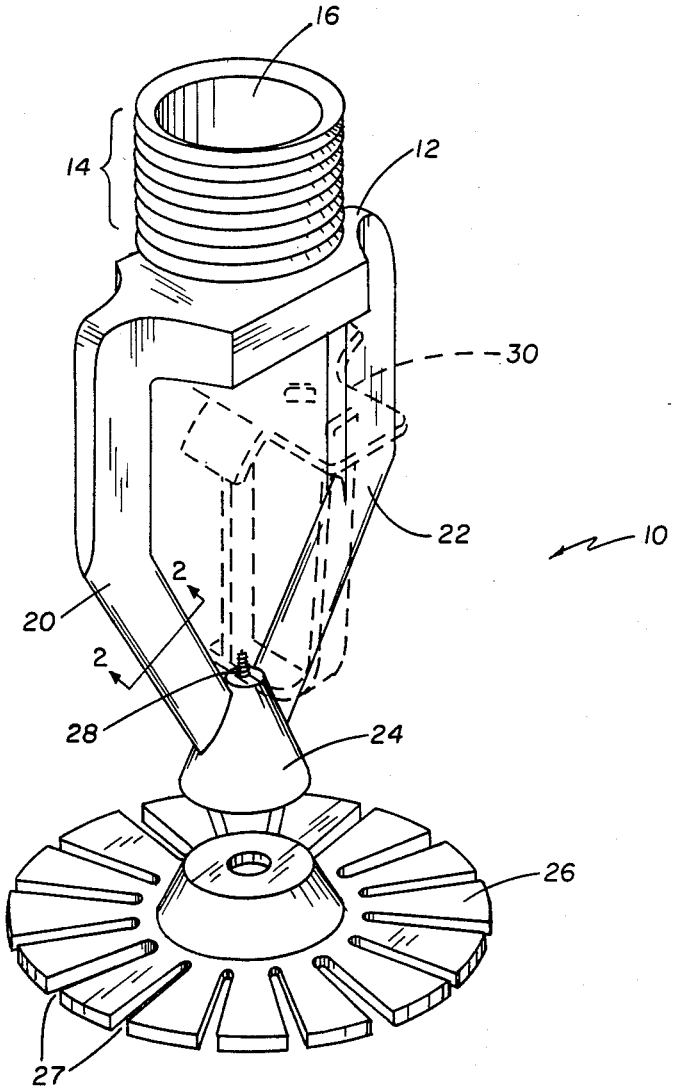
FIG. 1 is a perspective view of a fire protection sprinkler having a configuration according to the invention.

Referring to FIG. 1, a pendent sprinkler head 10 has a base 12 threaded at 14 for connection to the outlet of a fire retardant fluid piping system. The base has a circular inlet and passage 16 which terminates in a circular discharge throat 18 (FIG. 3) of predetermined cross-section, $D_t$, e.g. about 0.64 inch diameter. This outlet achieves a discharge coefficient (K-factor) of 11.2. (The K-factor relates the discharge "Q" in U.S. Gallons per minute to the pressure "P" in pounds per square inch (at the inlet to the sprinkler), by the relationship Q=[K-factor]×P.) Extending from the base at opposite sides of the throat are frame arms 20, 22 that join to generally conical central boss 24 to form an arch. The boss is supported by the arms in axial alignment with throat 18. Affixed to the base of the boss is a deflector 26 designed with slots 27 for achieving a high percentage of relatively large fluid drops. At the apex of boss 24 is loading pin 28, provided to receive the lower end of a thermally responsive element 30, shown in dashed line, which in standby condition rigidly retains a valve element that blocks flow of fluid from the throat.

Figure 2:
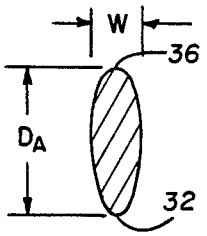
FIG. 2 is a section view along the line $C_1$ of FIG. 3.

Referring to FIG. 2, in cross-section each of the frame arms has a streamline shape, with a narrow leading edge 36 and a smooth, gradual transition to the region of maximum width and a smooth, gradual transition to the narrow trailing edge 32.

Figure 4:
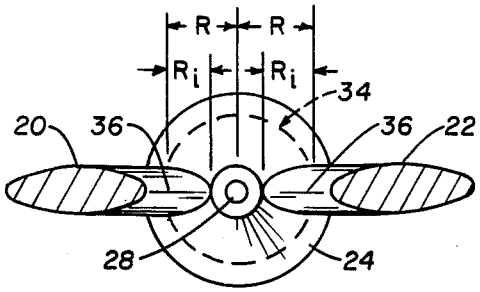
FIG. 4 is a top section view of the sprinkler head, taught at line 4—4 of FIG. 3.
Figure 5:
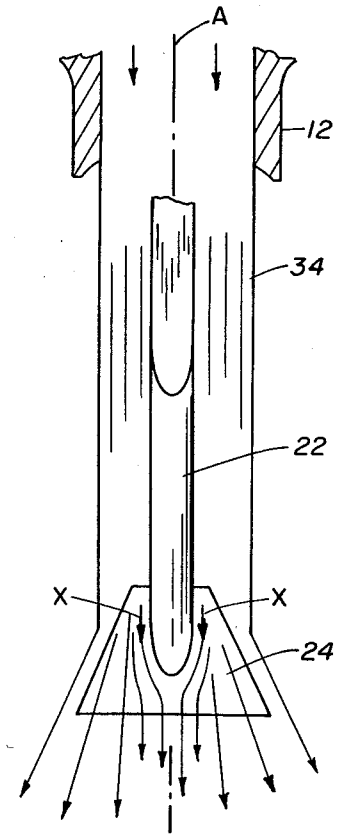
FIG. 5 is a similarly somewhat diagrammatic view of the sprinkler head from the side.
Figure 3:
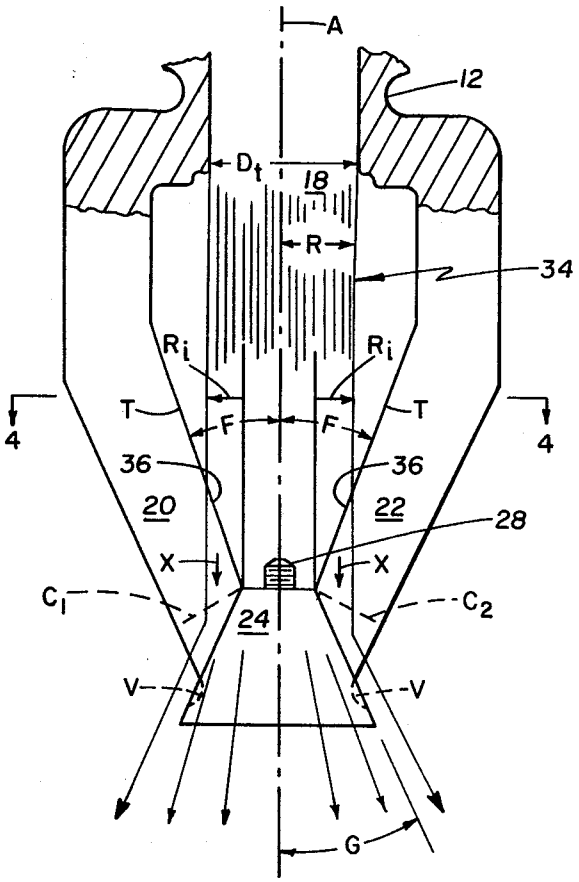

Referring to FIGS. 3, 4 and 5, the stream of fire retardant fluid 34 flowing from throat 18 of base 12, in addition to impinging upon the upper surface of the central boss 24, also, as a requirement of the invention, impinges to a significant degree upon the leading edges 36 of the frame arms in the region adjacent the boss. To achieve this effect the frame arm is positioned to substantially intercept the stream profile represented by the imaginary cylinder 34 projected from the orifice of the throat along the throat axis A. Whereas beneficial results can be obtained when the depth of interception $R_i$; is at least one third the radius R of the cylinder, in the preferred embodiment shown, $R_i$; is equal to one half R.

According to the invention, the frame arms 20, 22 extend upwardly and outwardly from the central boss 24 at a very acute angle, F, relative to the central axis, A. Measuring from axis A to the tangent T to each leading edge 36, the angle, F, at most should be about 25°, and in the preferred embodiment shown is about 20°.

Another requirement of the invention is that the cross-section through each frame arm in the region of fluid intercept, e.g. taken at the lead end of boss 24, along lines $C_1$, $C_2$, is long in the direction perpendicular to the leading edge 36. This dimension, $D_A$, should be at least two and in the preferred embodiment of FIG. 2 dimension $D_A$ is about three times the maximum width, W. Furthermore, it is desirable that the frame arm cross-section have narrow leading and trailing edges, with the region of maximum width, W, spaced from them as shown. In the preferred embodiment, the cross-section is of slender ellipsoidal shape to enhance the wall attachment effect for guiding the fluid around the frame arms.

In operation, when heat has caused the thermal element 30 to actuate and release the valve element from sprinkler throat 18, fire retardant fluid flows. Referring to FIG. 3, the fluid exits from the circular throat, moving in the general form of a cylindrical stream 34 toward central boss 24.

Figure 6:
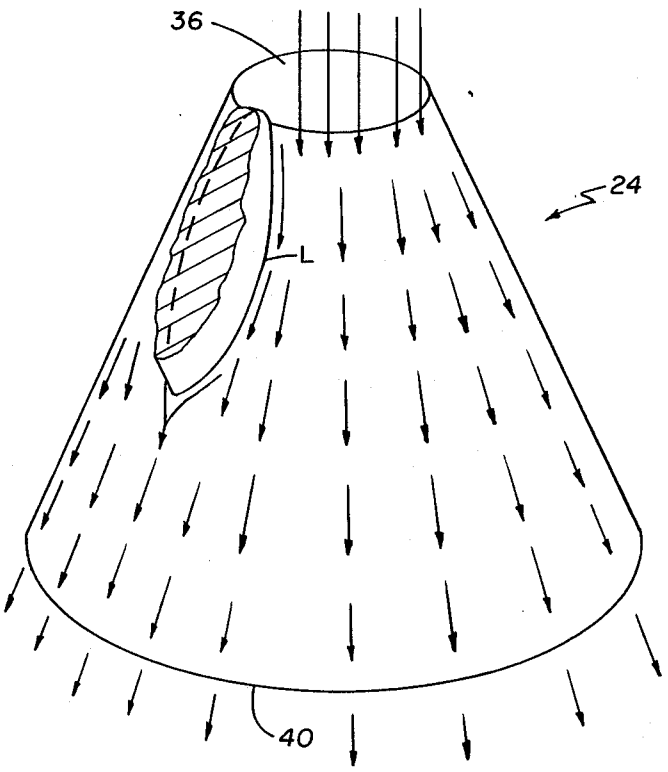
Figure 7:
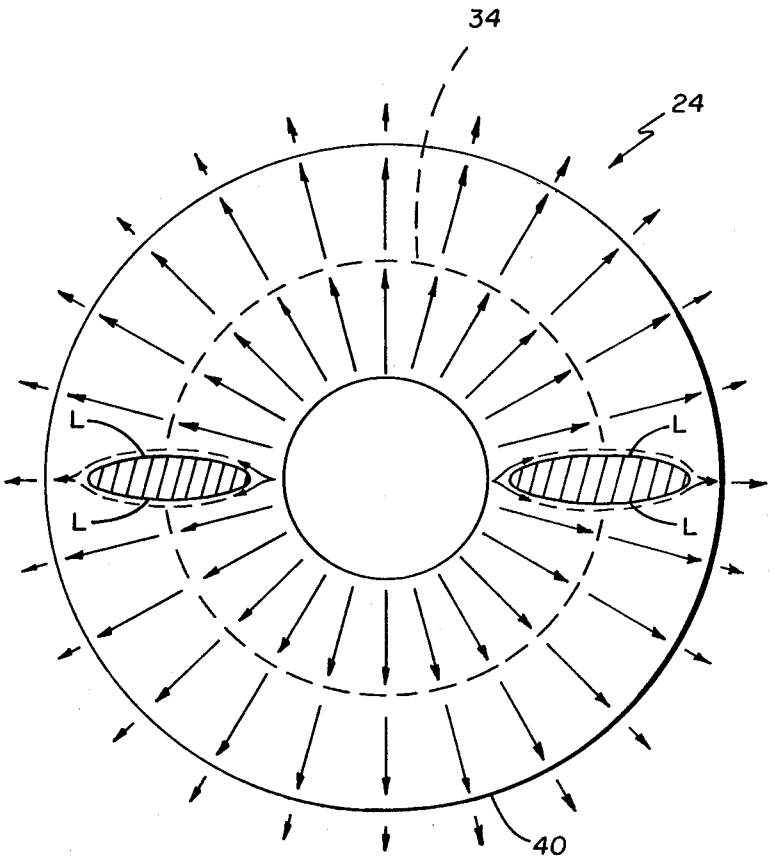
FIG. 7 is a plan view thereof.

Ignoring for the moment the regions of the frame arms, the surface of the central boss element otherwise uniformly intercepts the stream of fluid and directs it uniformly outwardly at an angle to the vertical, indicated by the arrows in FIGS. 6 and 7.

In the region of the leading edges 36 of the frame arms 20, 22, the flow of fluid toward the central boss element surface is intercepted. However, due to the described configuration and arrangement of the sprinkler head frame arms, the intercepted segment of flow is found to attach to the frame arm surface and, by the so-called "Coanda" effect, it is guided by the surface of the frame arm downwardly (arrows X, FIGS. 3 and 5). The portion of the flow intercepted by the frame arms and moving downwards, and the flow diverted along intersection L (FIGS. 6 and 7) on the boss, interact with the flow over the nearby region on the boss. The result of this interaction is that the outward flow at the final periphery of the central boss element is restored to be substantially uniform.

Figure 8:
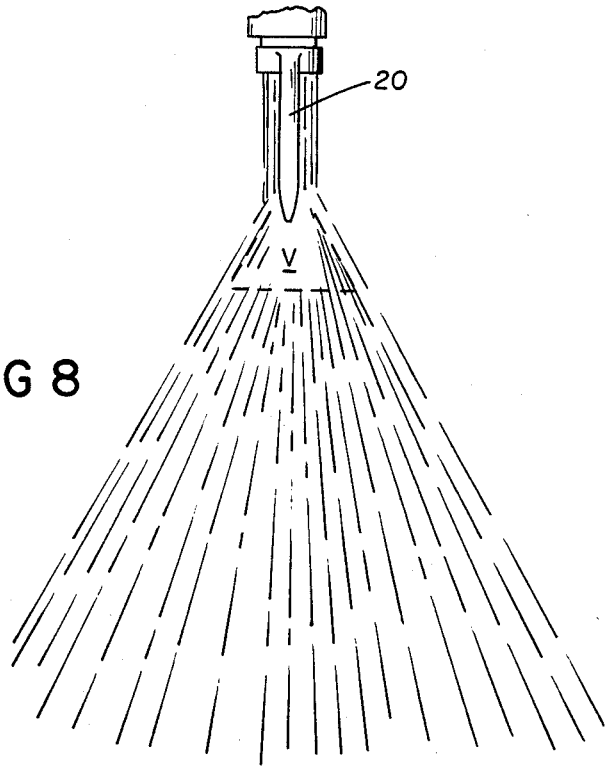
FIGS. 8 and 8*a* are side and front representations of strobe photographs of the flow from a sprinkler head of the invention, without the spray distributing deflector attached.
Figure 8A:
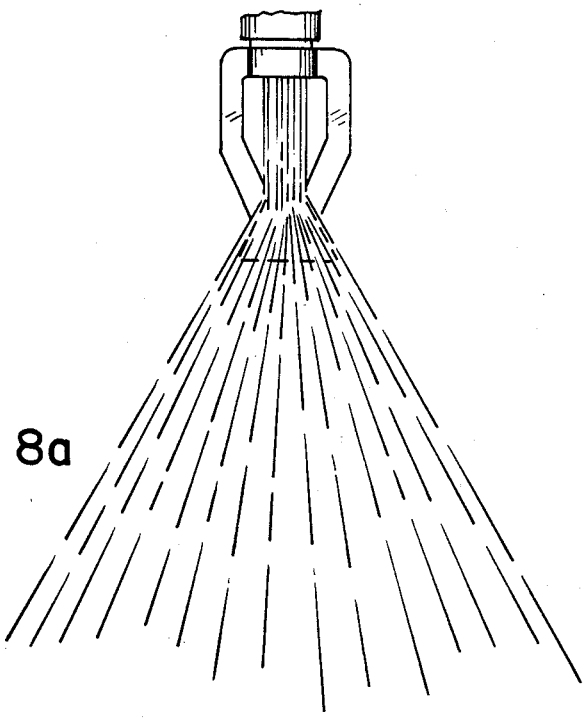

FIGS. 8 and 8*a* are representations of stroboscopic photographs of a sprinkler head of the invention without the deflector 26 being present. In FIG. 8, it is seen that the fluid flows uniformly from the periphery of the boss element, including from region V directly beneath the frame arm 20. In FIG. 8*a*, the fluid stream intercepted by the frame arms appears to continue downward along the frame arms to the boss with little disruption by the frame arms. With the deflector installed, an extremely uniform spray pattern is achieved.

Other embodiments of the invention within certain of the following claims can achieve some of the benefits of the invention. For example, the frame arm cross-section may be of slender wedge-shape, with the pointed end corresponding to the leading edge. However, in such case, to properly guide the fluid to flow into the region immediately downstream of the trailing edge of the wedge-shape, the angle of intersection of the frame arm surfaces with the central plane of the frame arm cross-section should be no more than about 12°. The sprinkler frame has been shown to be effective with truncated cone-type central boss elements having an outward angle G (FIG. 3) of about 5° to 50°, and with bosses of other configurations. The configuration of the boss surface may be used to affect distribution of flow, e.g. the surface may be elliptical, with the major diameter aligned with the plane of the frame arms, and bosses with faceted surfaces have also been suggested. The design may also be used for sprinkler heads configured with other discharge coefficients, as for example, a head with a K-factor of 2.8, 5.5, 7.8 or 15.6.

What is claimed is:

1. In a fire protection sprinkler head of the type including a base having a throat of predetermined cross-section through which a stream of fire retardant fluid can flow and a frame comprising two or more frame arms and a central boss for supporting a spray distributing deflector, said frame arms extending outwardly from said base and joining in an arch-form to support said boss at a position spaced from and disposed in the path of fluid discharged from said throat, said boss being adapted to deflect fluid outwardly therefrom, towards said spray distributing deflector, the improvement wherein said frame arms conform to the following set of three parameters:

(i) the portion of each frame arm in the region adjacent said boss is shaped and positioned to intercept the stream profile to a depth of at least one third of the distance from the outside periphery to the center of the stream profile, said profile comprising a projection parallel to the axis of flow, of the exit cross-section of said throat;

(ii) the angle of the leading edge of each frame arm in said fluid intercept region, relative to said axis of flow, is less than about 25 degrees; and (iii) the cross-section of each frame arm in the fluid intercept region is slender, the length of said cross-section, measured perpendicular to the leading edge of the frame arm, being two or more times the maximum thickness of the frame arm, the surfaces of each frame arm being shaped to guide the fluid intercepted by said frame arm to flow into the region immediately downstream of its trailing edge, thereby to provide a sprinkler distribution pattern not substantially disturbed by frame shadow effects.

2. The sprinkler head of claim 1 wherein said angle of said leading edge of each frame arm is about 20 degrees.

3. The sprinkler head of claim 1 or 2 wherein said portion of each frame arm in the region adjacent said boss is shaped and positioned to intercept said stream profile to a depth of about one half of the distance from the outside periphery to the center of said profile.

4. The sprinkler head of claim 1 or 2 wherein said length of the cross section of each frame arm in the fluid intercept region is about three times the maximum thickness of the frame arm.

5. The sprinkler head of claim 1 or 2 wherein the leading edges of said frame arms in said fluid intercept region are substantially straight.

6. In a fire protection sprinkler head of the type including a base having a throat of predetermined cross-section through which a stream of fire retardant fluid can flow and a frame comprising two or more frame arms and a central boss for supporting a spray distributing deflector, said frame arms extending outwardly from said base and joining in an arch-form to support said boss at a position spaced from and disposed in the path of fluid discharged from said throat, said boss being adapted to deflect fluid outwardly therefrom, towards said spray distributing deflector, the improvement wherein said frame arms conform to the following parameters:

(i) the portion of each frame arm in the region adjacent said boss is shaped and positioned to intercept about one half of the radial dimension of the stream profile, said profile comprising a projection, parallel to the axis of flow, of the exit cross-section of said throat, said exit cross-section being substantially circular;

(ii) the leading edge of each frame arm in said fluid intercept region is substantially straight and forms an angle, relative to the axis of flow, of about 20 degrees; and (iii) the cross-section of each frame arm is of generally streamline shape with narrow leading and trailing portions, the length of the cross-section of each frame arm in the fluid intercept region, measured perpendicular to the leading edge of the frame arm, being about three times the maximum thickness of the frame arm, whereby fluid intercepted by each frame arm can be guided to flow into the region immediately downstream of the trailing edge of said frame arm to provide a substantially uniform sprinkler distribution pattern essentially free of frame shadow effects.

7. The sprinkler head of claim 1 or 6 wherein said cross-section of each said frame arm is generally ellipsoidal.

* * * * *